US011635247B2

(12) United States Patent
Kim et al.

(10) Patent No.: US 11,635,247 B2
(45) Date of Patent: Apr. 25, 2023

(54) REFRIGERATOR

(71) Applicant: SAMSUNG ELECTRONICS CO., LTD., Suwon-si (KR)

(72) Inventors: Byoung Mok Kim, Hwaseong-si (KR); Jae Young Choi, Incheon (KR); Yong Bum Seo, Hwaseong-si (KR); Sang Gyu Jung, Suwon-si (KR); Jeong Hyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 396 days.

(21) Appl. No.: 16/643,691

(22) PCT Filed: Aug. 14, 2018

(86) PCT No.: PCT/KR2018/009346

§ 371 (c)(1),
(2) Date: Mar. 2, 2020

(87) PCT Pub. No.: WO2019/045328

PCT Pub. Date: Mar. 7, 2019

(65) Prior Publication Data

US 2021/0156606 A1 May 27, 2021

(30) Foreign Application Priority Data

Aug. 29, 2017 (KR) ..... 10-2017-0109599

(51) Int. Cl.

| | |
|---|---|
| ***F25D 23/02*** | (2006.01) |
| ***E05B 1/00*** | (2006.01) |
| ***E05C 7/02*** | (2006.01) |

(52) U.S. Cl.
CPC ..... *F25D 23/025* (2013.01); *E05B 1/0038* (2013.01); *E05C 7/02* (2013.01);
(Continued)

(58) Field of Classification Search
CPC .... F25D 23/025; F25D 23/028; E05B 1/0038; E05C 7/02
See application file for complete search history.

(56) References Cited

U.S. PATENT DOCUMENTS 2,459,658 A * 1/1949 Klein ..... A47J 45/078 24/612
3,648,411 A * 3/1972 Saunders ..... E05B 1/0015 49/460

(Continued)

FOREIGN PATENT DOCUMENTS

CN 104864658 8/2015
DE 9000885 5/1990

(Continued)

OTHER PUBLICATIONS

Chinese Office Action dated Mar. 25, 2021 from Chinese Application No. 201880056262.6, 17 pages.

(Continued)

*Primary Examiner* — James O Hansen
(74) *Attorney, Agent, or Firm* — Staas & Halsey LLP

(57) ABSTRACT

Disclosed herein is a refrigerator in which the structure of a door is improved. The refrigerator includes a main body having a storage compartment, a door rotatably coupled to the main body to open or close the storage compartment and having a door frame, a coupling member coupled to the door frame, and a door handle coupled with the coupling member in a sliding manner.

5 Claims, 20 Drawing Sheets

(52) U.S. Cl.
CPC ..... *F25D 23/028* (2013.01); *E05Y 2900/31* (2013.01); *F25D 2323/021* (2013.01); *F25D 2323/023* (2013.01)

(56) References Cited

U.S. PATENT DOCUMENTS

| | | | | |
|---|---|---|---|---|
| 8,732,910 | B1 | 5/2014 | Paul et al. | |
| 9,448,004 | B2 | 9/2016 | Kim et al. | |
| 2004/0010888 | A1* | 1/2004 | Wing | E05B 1/0015 16/436 |
| 2005/0161461 | A1* | 7/2005 | Shin | E05B 1/0015 220/752 |
| 2006/0143865 | A1* | 7/2006 | Magyar | A47B 95/02 16/412 |
| 2006/0200948 | A1* | 9/2006 | Steurer | E05B 1/0015 16/412 |
| 2014/0232251 | A1* | 8/2014 | Kim | F25D 23/025 312/405 |
| 2017/0010040 | A1 | 1/2017 | Kim et al. | |

FOREIGN PATENT DOCUMENTS

| | | |
|---|---|---|
| EP | 0976898 | 2/2000 |
| EP | 2910879 | 8/2015 |
| JP | 59-18277 | 2/1984 |
| JP | 61-89790 | 6/1986 |
| JP | 61-153895 | 9/1986 |
| JP | 62-42661 | 3/1987 |
| JP | 62-152183 | 9/1987 |
| JP | 10-9757 | 1/1998 |
| KR | 10-2007-0065743 | 6/2007 |
| KR | 10-2008-0100622 | 11/2008 |
| KR | 10-2014-0053539 | 5/2014 |
| KR | 10-2015-0099024 | 8/2015 |
| KR | 10-2016-0023741 | 3/2016 |
| KR | 10-2017-0064863 | 6/2017 |

OTHER PUBLICATIONS

Chinese Office Action dated Oct. 13, 2021 from Chinese Application No. 201880056262.6.
Korean Office Action dated Feb. 23, 2022 from Korean Application No. 10-2017-0109599.
International Search Report dated Dec. 12, 2018 in corresponding International Patent Application No. PCT/KR2018/009346.
Extended European Search Report dated Jul. 15, 2020 from European Application No. 18849569.1, 9 pages.
Korean Office Action dated Aug. 3, 2021 from Korean Application No. 10-2017-0109599.
European Office Action dated Aug. 26, 2022 for European Application No. 18849569.1.

* cited by examiner

REFRIGERATOR

CROSS-REFERENCE TO RELATED APPLICATIONS

This application is a U.S. National Stage Application which claims the benefit under 35 U.S.C. § 371 of International Patent Application No. PCT/KR2018/009346 filed on Aug. 14, 2018, which claims foreign priority benefit under 35 U.S.C. § 119 of Korean Patent Application No. 10-2017-0109599 filed on Aug. 29, 2017 in the Korean Intellectual Property Office, the contents of all of which are incorporated herein by reference.

TECHNICAL FIELD

The present disclosure relates to a refrigerator, and more particularly, to a refrigerator in which the structure of a door is improved.

BACKGROUND ART

Generally, a refrigerator is a home appliance capable of keeping foods in fresh by providing a storage compartment configured to store the foods and a cold air supply device configured to supply cold air to the storage compartment.

The refrigerator includes components for a refrigeration cycle therein, and is a device that refrigerates or freezes an object stored in the storage compartment through the cool air generated from the components for the refrigeration cycle.

The refrigerator may be classified according to the type of storage compartment and type of door.

There are top mounted freezer (TMF) type refrigerators in which a storage compartment is divided into an upper portion and a lower portion by a horizontal partition wall to form a freezing compartment at an upper side of the storage compartment and a refrigerating compartment at a lower side thereof, and a bottom mounted freezer (BMF) type refrigerator in which a storage compartment is divided into an upper portion and a lower portion by a horizontal partition wall to form a refrigerating compartment at an upper side of the storage compartment and a freezing compartment at a lower side thereof.

In addition, there is a French door type refrigerator (FDR) in which a refrigerating compartment at the upper side is opened and closed by pair of doors in the bottom mounted freezer (BMF) type refrigerator in which a storage compartment is divided into an upper portion and a lower portion by a horizontal partition to form the refrigerating compartment at an upper side of the storage compartment and a freezing compartment at a lower side thereof.

Meanwhile, there is a side-by-side (SBS) type refrigerator in which a storage compartment is divided into left and right sides by a vertical partition wall to form a freezing compartment at one of the left and right sides and a refrigerating compartment chamber at the other side thereof.

DISCLOSURE

Technical Problem

It is an aspect of the present disclosure to provide a refrigerator having an improved structure capable of increasing the convenience of assembly of a door handle reducing the number of a coupling member and a fixing member the door handle.

It is another aspect of the present disclosure to provide a refrigerator capable of allowing a user to intuitively distinguish an inner door handle and an outer door handle by a difference in depth of a finger of the user gripping the door handle when the door is opened.

It is another aspect of the present disclosure a refrigerator capable of opening an outer door with out opening an inner door or opening the inner door together with the outer door.

It is another aspect of the present disclosure to provide a refrigerator capable of coupling an insulating partition wall, which is configured to seal between an upper door and a lower door, to an inner case after being manufactured separately from a main body including the inner case and an outer case.

Technical Solution

In accordance with an aspect of the present disclosure, a refrigerator includes a main body having a storage compartment, a door rotatably coupled to the main body to open and close the storage compartment, and having a door frame, a coupling member coupled to the door frame, and a door handle coupled with the coupling member in a sliding manner.

In order to be coupled with the coupling member, the door frame may include a coupling hole having a coupling hole provided at a front surface of the door frame and a second coupling hole extended from the first coupling hole and larger than the first coupling hole.

The coupling member may be coupled to the coupling hole in a sliding manner and include a first coupling portion coupled to the first coupling hole and a second coupling portion provided at an upper side of the first coupling portion and coupled to the second coupling hole.

The coupling member may further include a supporting portion coupled to a rear surface of the door frame, and a frame engaging portion extended forward from the supporting portion and disposed at the front surface of the door frame so that the coupling member is coupled to the door frame.

The supporting portion may be provided to prevent the coupling member from being detached from the coupling hole, and the frame engaging portion may be provided to prevent the first coupling portion from being detached from the first coupling hole.

A width of the frame engaging portion may be larger than a width of the first coupling hole, and smiler than a width of the second coupling hole.

The first coupling portion may include a handle engaging portion extended forward from the frame engaging portion so that the door handle is coupled to the coupling member.

The door handle may include a receiving portion coupled with the coupling member and a grip portion bent and extended from the receiving portion.

The receiving portion may include a first receiving portion in which the frame engaging portion is received and a second receiving portion in which the handle engaging portion is received.

The receiving portion may further include a protruding portion protruded inward of the receiving portion between the first receiving portion and the second receiving portion to prevent the door handle from being detached from the coupling member.

The door handle may include a fixing member provided to prevent the handle from being detached from the coupling member and a fixing hole coupled with the fixing member.

The fixing member may be disposed on the first coupling portion and in front of the second coupling portion, when the door handle is coupled to the coupling member.

The door may include an inner door rotatably provided at the main body and having an inner door frame, and an outer door rotatably provided at the inner door, and wherein the door handle may include an inner door handle coupled to the inner door frame to open the inner door together with the outer door, and an outer door handle provided at the outer door to protrude outward than the inner door handle.

The outer door may include a striker disposed at an upper portion of the outer door to couple the outer door to the inner door or detach the outer door from the inner door, and the inner door may include a latch provided at the upper portion of the inner door to correspond to the striker and a latch cover disposed at a front surface of the inner door frame to receive the latch and the striker.

The inner door handle may include a first striker hole disposed at an upper portion of the inner door handle so that the striker passes through the first striker hole, and the latch cover may include a second striker hole provided to correspond to the first striker hole and a cover cap provided to cover the first striker hole and the second striker hole.

ADVANTAGEOUS EFFECTS

As is apparent from the above description, the convenience of assembling the door handle may be increased, and the quality of the appearance of the door handle may be improved.

The door may be easily opened and closed because the user may intuitively distinguish the door handle of the double door.

The double door may be opened smoothly.

The insulation of the storage compartment may be efficient performed because an insulating material may be uniformly filled in an insulating partition wall provided to seal between the upper door and the lower door.

BEST MODEL

Mode for Invention

Figure 1:
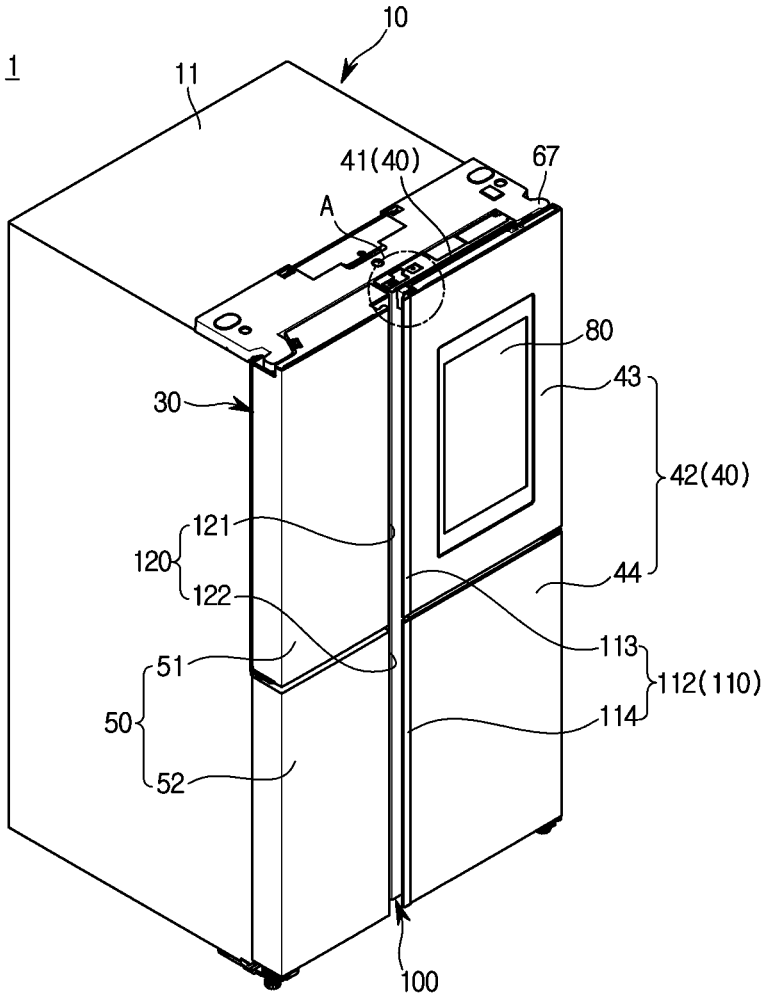
FIG. 1 is a perspective view of a refrigerator according to an embodiment of the present disclosure.

Embodiments described herein and configurations shown in the accompanying drawings are merely examples of the present disclosure, and various modified examples that may replace the embodiments and the accompanying drawings of the present disclosure may be made at the time at which the present application is filed.

Further, like reference numerals or symbols given in the various drawings of the present specification indicate parts or components that perform substantially the same functions.

Also, the terms used herein are used to describe the embodiments and are not intended to restrict and/or limit the present disclosure. Unless the context clearly dictates otherwise, the singular form includes the plural form.

In this description, the terms "comprising," "having," or the like are used to specify that a feature, a number, a step, an operation, a component, an element, or a combination thereof described herein exists, and they do not preclude the presence or addition of one or more other features, numbers, steps, operations, components, elements, or combinations thereof.

Further, it should be understood that terms including ordinals such as "a first, a second" and the like may be used herein to describe various components, but the components are not limited to the terms and these are used only for the purpose of distinguishing one component from another.

For example, without departing from the scope of the present disclosure, a first component may be referred to as a second component, and similarly, a second component may also be referred to as a first component.

The term "and/or" includes a combination of a plurality of related listed items and any one item of the plurality of related listed items.

Hereinafter, embodiments of the present disclosure will be described in detail with reference to the accompanying drawings.

Figure 2:
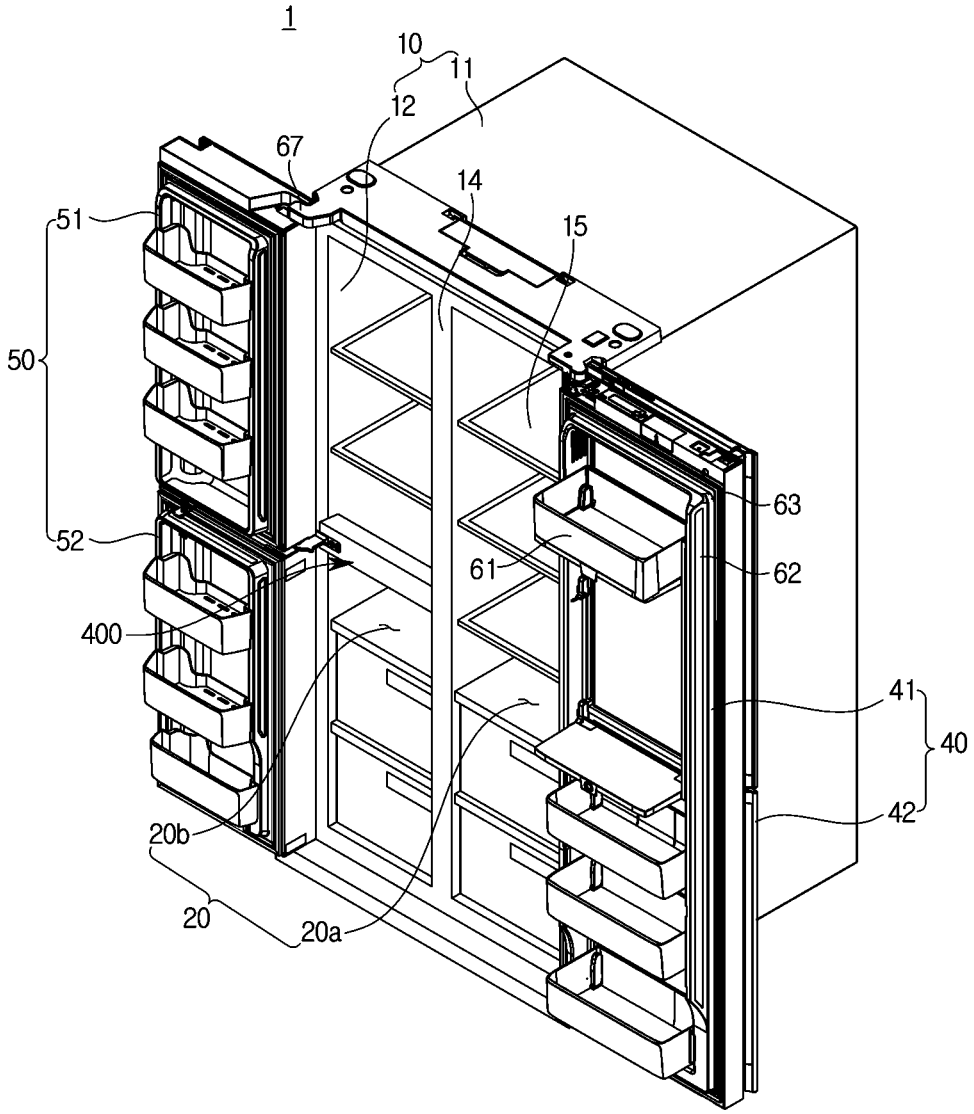
FIG. 2 is a view illustrating a state in which a door is opened in the refrigerator according to an embodiment of the present disclosure
Figure 3:
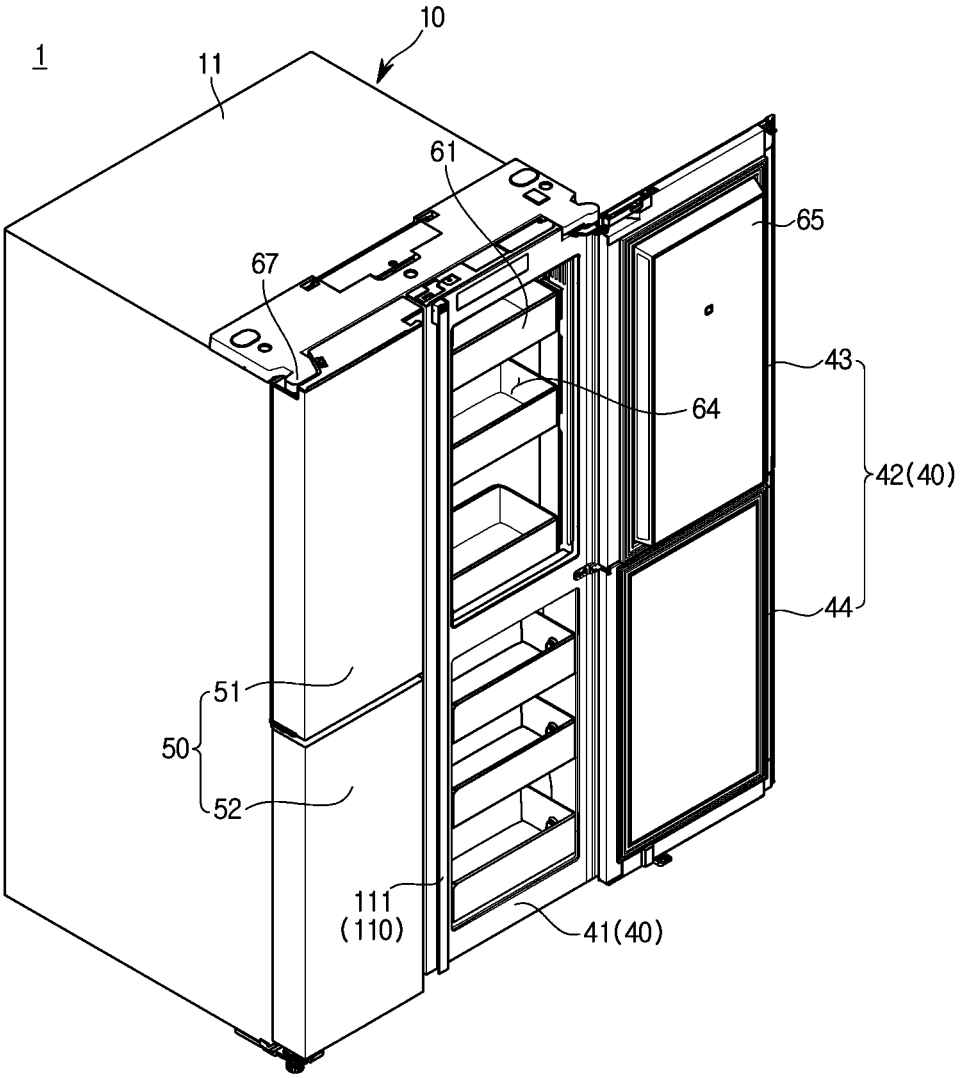
FIG. 3 is a view illustrating a state in which an outer door is opened in the refrigerator according to an embodiment of the present disclosure.

FIG. 1 is a perspective view of a refrigerator according to an embodiment of the present disclosure. FIG. 2 is a view illustrating a state in which a door is opened in the refrigerator according to an embodiment the present disclosure. FIG. 3 is a view illustrating a state in which an outer door is opened in the refrigerator according to an embodiment of the present disclosure.

As shown in FIGS. 1 to 3, a refrigerator 1 may include a main body 10, and a storage compartment 20 formed inside the main body 10. The refrigerator 1 may include a door 30 configured to open and close the storage compartment 20, and a cold air supply unit (not shown) configured to supply cold air to the storage compartment 20.

The main body 10 may include an inner case 12 configured to form the story compartment 20, and an outer case 11 connected to the outside of the inner case 12 to form an exterior of the main body 10. The main body 10 may include insulation (not shown) to be foamed between the inner case 12 and the outer case 11 to insulate the storage compartment 20.

The cold air supply unit (not shown) may generate cold air using a cooling cycle that compresses, condenses, expands, evaporates a refrigerant.

A front surface of the storage compartment 20 may be provided to be opened, and the storage compartment 20 may be divided into a refrigerating compartment 20*a* at a right side thereof and a freezing compartment 20*b* at a left side thereof by a vertical partition wall 14. However, the present disclosure is not limited thereto, and the positions of the refrigerating compartment 20*a* and the freezing compartment 20*b* may be variously provided. The storage compartment 20 may include a plurality of shelves 15.

The storage compartment 20 may be opened and closed by the door 30 rotatably coupled to the main body 10. The door 30 configured to open and close the storage compartment 20 may be laterally disposed thereat.

The refrigerating compartment 20*a* may be opened and closed by a first door 40 rotatably coupled to the main body 10, and the freezing compartment 20*b* may be opened and closed by a second door 50 rotatably coupled to the main body 10.

The second door 50 may include an upper door 51 rotatably coupled to the upper portion of the main body 10, and a lower door 52 disposed at the lower portion of the upper door 51.

The main body 10 may include an insulating partition wall 400 to be coupled with the inner case 12 to be positioned between the upper door 51 and the lower door 52. The insulating partition wall 400 may not divide the freezing compartment 20*b* up and down.

Namely, the insulating partition wall 400 may be formed only partially in the front portion of the inner case 12 to have a surface to which a gasket 63 of the upper door 51 and the lower door 52 may be in close contact. A space between a rear end of the insulating partition wall 400 and a rear wall of the freezing compartment 20*b* may be empty The shelf 15 may be mounted in the empty space between the rear end of the insulating partition wall 400 and the rear wall of the freezing chamber 20*b*. A detailed description of the detailed structure of the insulating partition wall 400 is given below.

The first door 40 may include an inner door 41 arranged in a double and rotatably coupled to the main body 10, and a second door 50 rotatably coupled to the inner door 41 to cover the inner door 41.

An outer door 42 may include a first outer door 43 rotatably coupled to an upper portion of the inner door 41 and a second outer door 44 rotatably coupled to a lower portion of the inner door 41 to be disposed at the lower portion of the first outer door 43.

The door 30 may include a door handle 100 that can be gripped by the user to open and close the door 30.

The door handle 100 may include a first door handle 110 arranged to grip the first door 40 and a second door handle 120 arranged to grip the second door 50.

The second door handle 120 may include an upper door handle 121 arranged to grip the upper door 51 and a lower door handle 122 arranged to grip the lower door 52.

The first door handle 110 may include an inner door handle 111 arranged to grip the inner door 41 and an outer door handle 112 arranged to grip the outer door 42.

The outer door handle 112 may include a first outer door handle 113 arranged to grip the first outer door 43 and a second outer door handle 114 arranged to grip the second outer door 44.

A door guard 61 may be provided at a rear surface of each of the first door 30 and the second door 50 to receive foods. The door 30 may include a guard supporting portion 62 extending vertically from the door 30 to support the door guard 61 at left and right sides thereof.

The guard supporting portion 62 may be separably provided at the door 30 as a separate configuration.

The gasket 63 may be provided at an edge of the rear surface of the door 30 to seal a gap between the main body 10 and the door 30 in a state in which the door 30 is closed. The gasket 63 may be installed in a form of a loop along the edge of the rear surface of the door 30, and a magnet (not shown) may be contained in the gasket 63.

The inner door 41 may include a door opening 64 having an open interior. The outer door 42 may be configured to cover the door opening 64 of the inner door 41.

The refrigerator 1 may include a display 80 having an input and output function. For convenience of a user, the display 80 may be installed at the front surface of the door 30. The display 80 may be provided at the first outer door 43.

A display mounting portion 65 may be formed to be recessed at the front surface of the first door 43 to allow the display 80 to be installed thereon. Since the display 80 is formed in a substantially quadrangular shape, the display mounting portion 65 may also be formed in a quadrangular shape.

The refrigerator 1 may include an electric wire (not shown) connecting the door 30 to the main body 10 for an electronic device installed at the door 30. For example, the electric wire (not shown) may be connected to the display 80 to transmit information between the display 80 and the controller, or to supply power to the display 80.

The main body 10 may include a hinge 67. By the hinge 67, the inner door 41 and the outer door 42 can be operated in an open state with respect to the main body 10. The outer door 42 can be operated in an open state with respect to the inner door 41 by the hinge 67.

Figure 4:
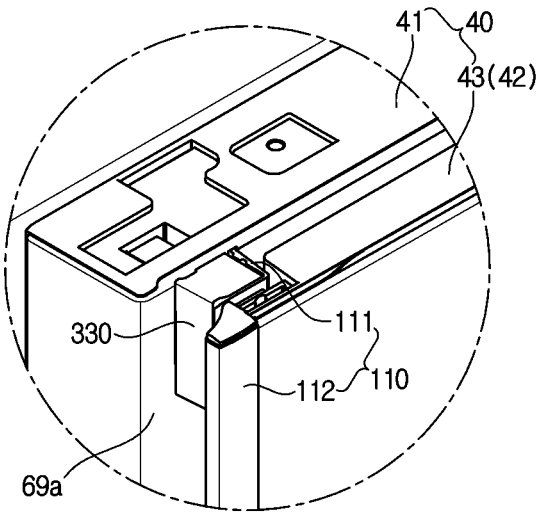
FIG. 4 is an enlarged view illustrating a portion A in the refrigerator shown in the FIG. 1.
Figure 5:
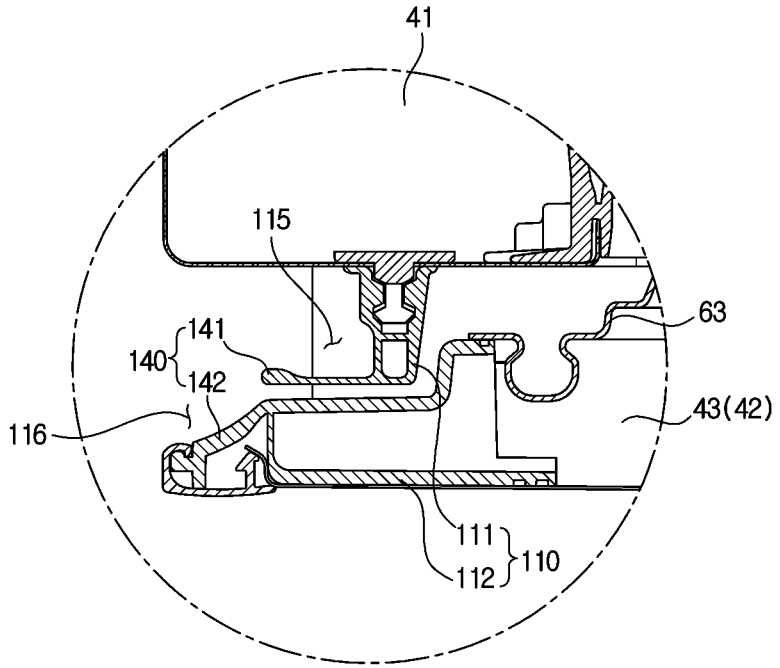
FIG. 5 is an enlarged cross-sectional view illustrating a portion A in the refrigerator shown in the FIG. 1.

FIG. 4 is an enlarged view illustrating a portion A in the refrigerator shown in the FIG. 1. FIG. 5 is an enlarged cross-sectional view illustrating a portion A in the refrigerator shown in the FIG. 1.

As shown in FIGS. 4 and 5, the first door handle 110 may include the inner door handle 111 coupled to an inner door frame 69*a* provided at the inner door 41 to open the inner door 41 together with the outer door 42.

The first door handle 110 may include the outer door handle 112 provided at the outer door 42 to only open the outer door 42.

The first door handle 110 may include a grip portion 140 extending toward the outside of the first door 40 when the first door 40 is closed. The inner door handle 111 may include a first grip portion 141 extending toward the outside of the inner door 41 when the inner door 41 is closed.

The outer door handle 112 may include a second grip portion 142 extending toward the outside of the outer door 42 when the outer door 42 is closed. The second grip portion 142 of the outer door handle 112 may protrude more than the first grip portion 141 of the inner door handle 111.

The second grip portion 142 and the inner door 41 may have the same position in the direction toward the vertical partition wall 14. That is, the second grip portion 142 may have a position corresponding to one side edge of the inner door 41.

The inner door handle 111 may be covered by the outer door handle 112 so as not to be exposed to the outside when viewed from the front of the refrigerator 1.

The inner door handle 111 may include a first receiving groove 115 to receive a user's hand, and the outer door handle 112 may include a second receiving groove 116 to receive a user's hand.

The user can open the inner door 41 together with the outer door 42 by putting his or her hand into the first receiving groove 115, approaching the inner door handle 111, and gripping the first grip portion 141.

The user can open only the outer door 42 by putting his or her hand into the second receiving groove 116, approaching the outer door handle 112, and gripping the second grip portion 142.

That is, in the refrigerator 1 according to an embodiment of the present disclosure, lengths that the first grip portion 141 of the inner door handle 111 and the second grip portion 142 of the outer door handle 112 are extended toward the outside of the first door 40 when the first door 40 is closed may be different.

Therefore, the user can distinguish intuitively the inner door handle 111 and the outer door handle 112 by the depth difference of the finger of the user when the user grasps the first door handle 110.

The gasket 63 may be disposed between the inner door 41 and the outer door 42 to maintain sealing.

The refrigerator 1 according to an embodiment of the present disclosure may include a locking unit 300 to lock the outer door 42 and the inner door 41 and a latch cover 330 provided at the inner door frame 69*a* to cover the locking unit 300. A detailed description of the locking unit 300 and the latch cover 330 is given below.

Figure 6:
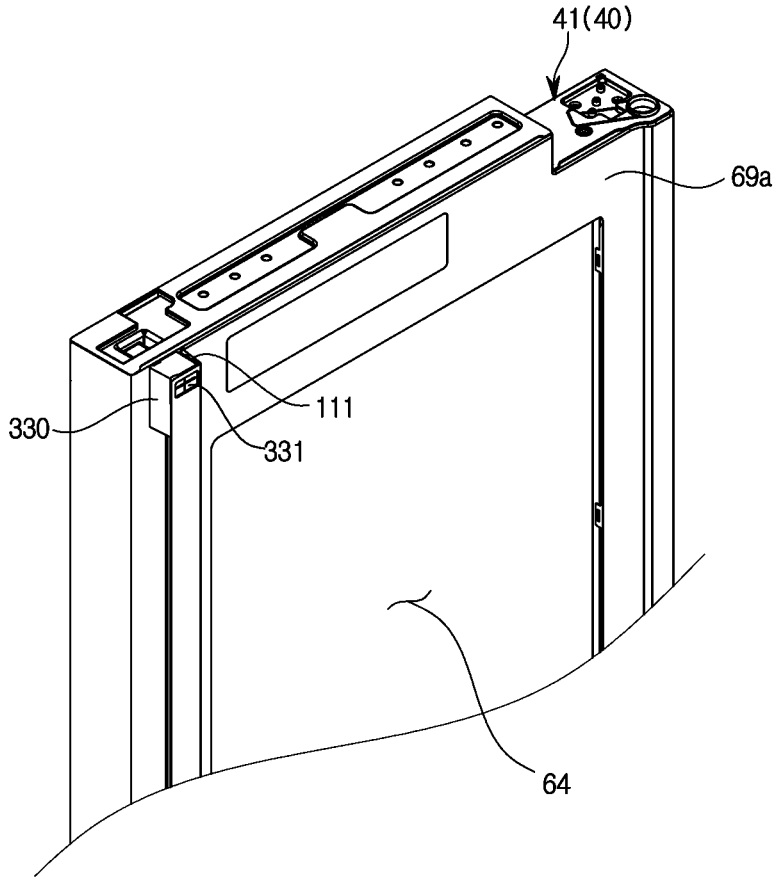
FIG. 6 is an enlarged perspective view illustrating an inner door in the refrigerator according to an embodiment of the present disclosure.
Figure 7:
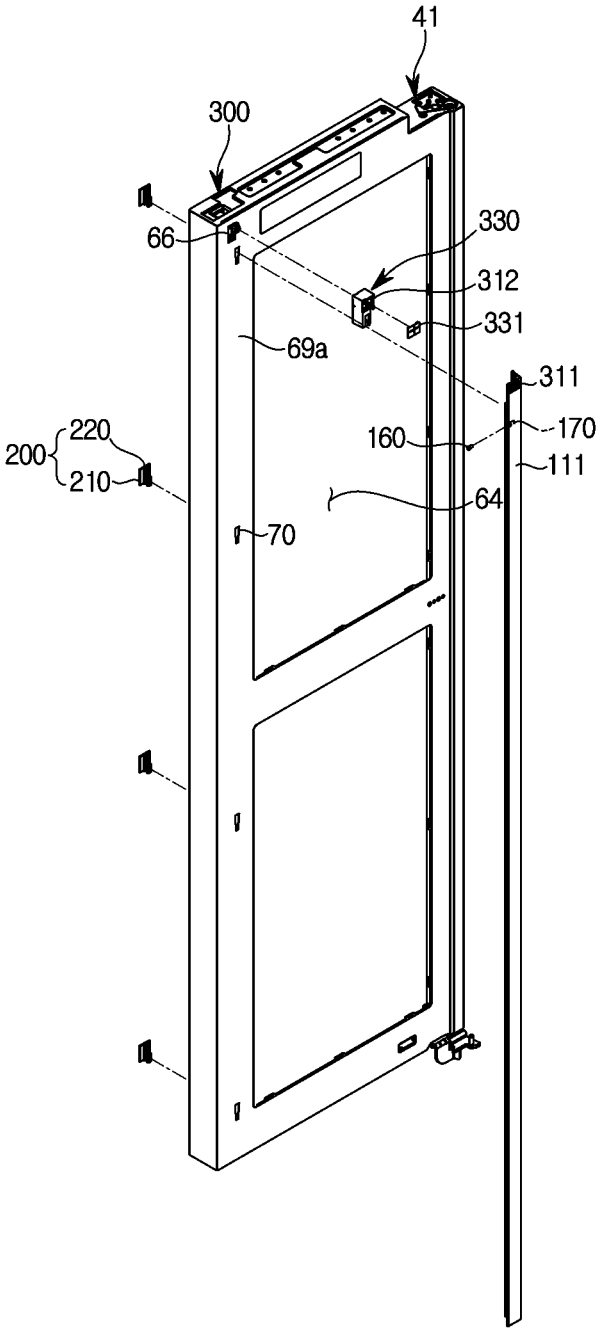
FIG. 7 is an exploded view illustrating the inner door in the refrigerator according an embodiment the present disclosure.

FIG. 6 is an enlarged perspective view illustrating an inner door in the refrigerator according to an embodiment of the present disclosure. FIG. 7 is an exploded view illustrating the inner door in the refrigerator according to an embodiment of the present disclosure.

As shown in FIGS. 6 and 7, the inner door 41 may include the inner door handle 111 coupled to the inner door frame 69*a*.

The inner door 41 may include a coupling member 200 coupled to the inner door frame 69*a* provided at the inner door 41 in a sliding manner and the inner door handle 111 coupled to the coupling member 200 in a sliding manner.

The user can freely grasp the first grip portion 141 of the inner door handle 111 from the upper portion to the lower portion of the inner door handle 111.

The inner door frame 69*a* may include a coupling hole 70 provided at the front surface of the inner door frame 69*a* to be coupled with the coupling member 200. Although the coupling holes 70 are illustrated as four in FIG. 7, the number of the coupling holes 70 is not limited thereto, and the number of the coupling holes 70 may be variously provided.

The coupling member 200 may include a first coupling portion 210 and a second coupling portion 220 extending upward from the first coupling portion 210 and having a smaller length protruding forward than the first coupling portion 210.

The inner door handle 111 may include a fixing member 160 provided to fix the inner door handle 111 to the coupling member 200 and a fixing hole 170 provided to allow the fixing member 160 to be inserted.

The movement of the inner door handle 111 in front-rear direction may be prevented because the inner door handle is inserted from the front to the rear of the inner door 41 and then coupled from the upper portion to the lower portion of the inner door 41 in a sliding manner.

That is, the fixing member 160 configured to fix the inner door handle 111 to the inner door 41 may be required only to prevent the inner door handle 111 from moving in the vertical direction. Accordingly, the refrigerator 1 according to an embodiment of the present disclosure may reduce the production cost by reducing the number of fixing members 160 configured to fix the inner door handle 111 to the inner door 41.

FIGS. 8A to 8F are a view illustrating a process in which an inner door handle is coupled to an inner door frame in the refrigerator according to an embodiment of the present disclosure. FIG. 9 is a cross-sectional view illustrating the inner door handle coupled to the inner door frame in the refrigerator according to an embodiment of the present disclosure.

Referring to FIGS. 8 to 9, the process in which the inner door handle 111 coupled to the inner door 41 is described.

Figure 8A:
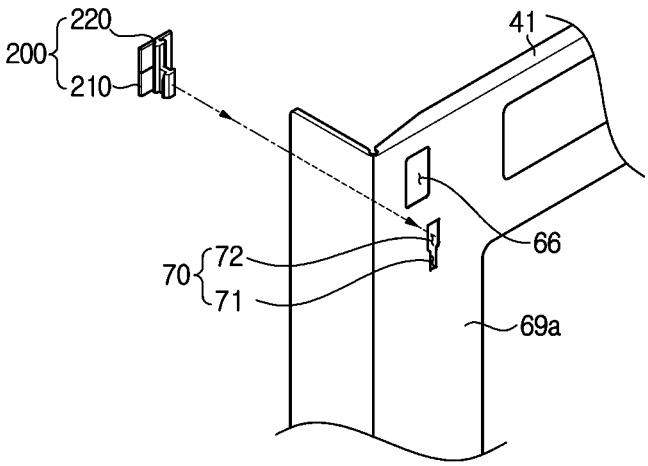
FIGS. 8A to 8F are a view illustrating a process in which an inner door handle is coupled to an inner door frame in the refrigerator according to an embodiment of the present disclosure.
Figure 8B:
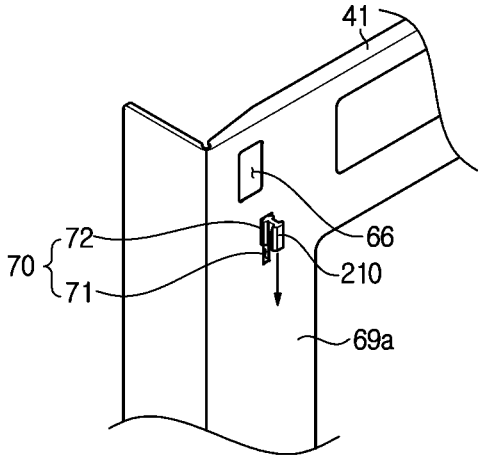
Figure 9:
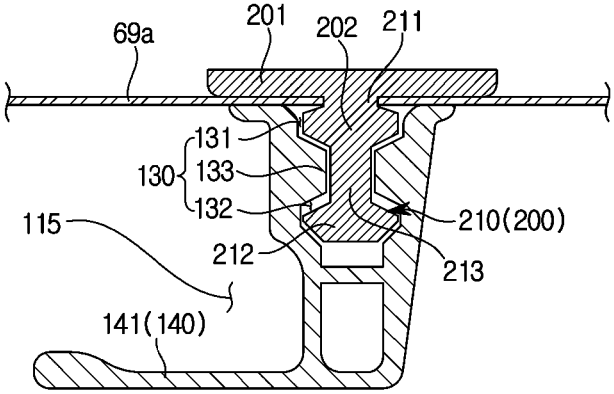
FIG. 9 is a cross-sectional view illustrating the inner door handle coupled to the inner door frame in the refrigerator according to an embodiment of the present disclosure.

As shown in FIGS. 8A and 8B, the inner door frame 69*a* may include the coupling hole 70 having a first coupling hole 71 provided at the front surface of the inner door frame 69*a* to be coupled with the coupling member 200 and a second coupling hole 72 extending from the first coupling hole 71 and having a size larger than the first coupling hole 71.

The coupling member 200 may include a first coupling portion 210 coupled to the first coupling hole 71 and a second coupling portion 220 coupled to the second coupling hole 72 and provided at the upper side of the first coupling portion 210.

First, the coupling member 200 may be inserted from the rear to the front of the inner door 41 toward the coupling hole 70 so that the first coupling portion 210 corresponds to the second coupling hole 72.

The first coupling portion 210 may be inserted directly into the second coupling hole 72 from the rear to the front of the second coupling hole 72, but the first coupling portion 210 may not be inserted directly into the first coupling hole 71 from the rear to the front of the first coupling hole 71.

This is because the width of a frame engaging portion 202 (see FIG. 9) of the engaging member 200 may be smaller than the width of the second coupling hole 72, but larger than the width of the first coupling hole 71.

The second coupling portion 220 extending from the upper side of coupling portion 210 may interfere with the rear surface of the inner door frame 69*a*, when the first coupling portion 210 is inserted into the second coupling hole 72.

At this time coupling member 200 may be inserted into the coupling hole 70 because interference between the coupling member 200 and the inner door frame 69*a* reduced by the elasticity as the coupling member 200 and the inner door frame 69*a*.

This is also possible because the length of the second coupling portion 220 protruding forward is relatively small than the length of the first coupling portion 210 protruding forward.

In FIGS. 8, the first coupling portion 210 and the second coupling portion 220 of the coupling member 200 are formed integrally with each other. However, the present disclosure is not limited thereto, the coupling member 200 may be formed by assembling the first coupling portion 210 and the second coupling portion 220.

Figure 8C:
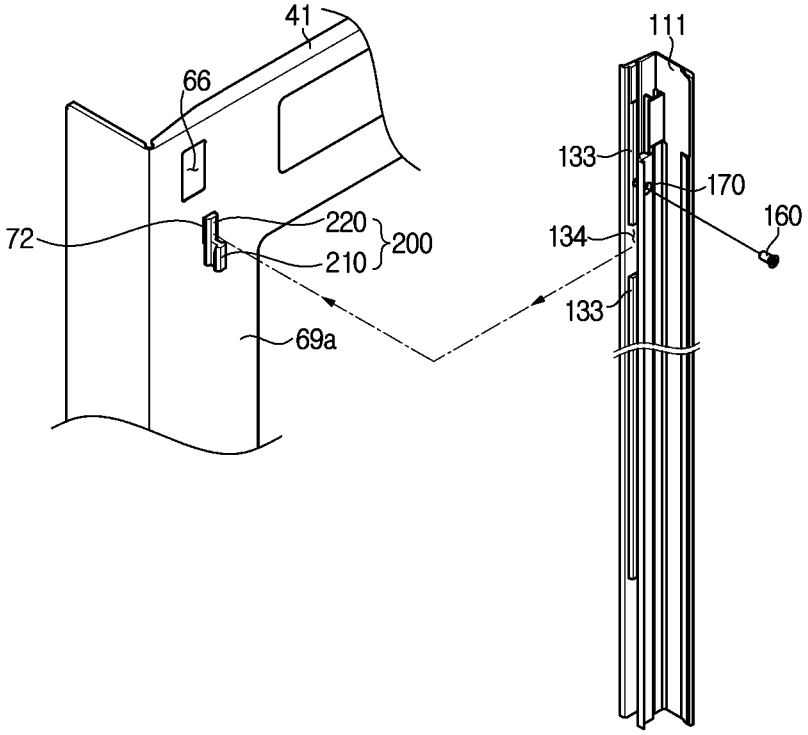

Next, as shown in FIGS. 8B and 8C, the coupling member 200 inserted into the second coupling hole 72 may be coupled to the first coupling hole 71 because the coupling member 200 is slid to the second coupling hole 72 down toward the first coupling hole 71.

When the coupling member 200 is fully coupled to the coupling hole 70 in a sliding manner, the empty space of the second coupling hole 72, which is covered by the first coupling portion 210, may be covered again by the second coupling portion 220.

Therefore, it is prevented that the second coupling hole 72 affects the appearance and it is possible to prevent the insulating material (not shown) from leaking through the second coupling hole 72.

A supporting portion 201 (see FIG. 9) of the coupling member 200 coupled to the inner door frame 69*a* may be supported by the insulating material (not shown) foamed inside the inner door 41.

Next when the coupling member 200 is coupled to the inner door frame 69*a*, the inner door handle 111 may be coupled to the coupling member 200 from the front to the rear of the inner door 41 so as to be coupled to the coupling member 200.

The inner door handle 111 may include protruding portions 133 protruding inward of the inner door handle 111 and a receiving groove 134 provided between the protruding portions 133.

The first coupling portion 210 may include a handle assembling port on 213 (see FIG. 9) extending forward from the frame engaging portion 202 and a handle engaging portion 212 (see FIG. 9) extending forward from the handle assembling portion 213.

The width of the handle engaging portion 212 may be larger than the width of the handle assembling portion 213. The width of the handle engaging portion 212 may be larger than the distance between the protruding portions 133 provided to opposite of the inner door handle 111.

Therefore, the inner door handle 111 may be coupled to the coupling member 200 from the front to the rear of the inner door 41 at a position where the handle emerging portion 212 of first coupling portion 210 and the receiving groove 134 correspond to each other.

Figure 8D:
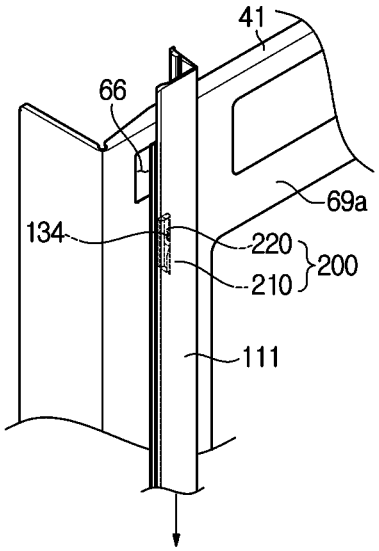
Figure 8E:
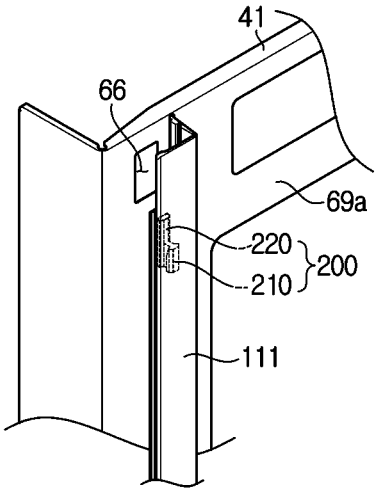

Next, as shown in FIGS. 8D and 8E, when the inner door handle 111 is coupled to the coupling member 200 so that the receiving groove 134 corresponds to the handle engaging portion 212, the inner door handle 111 may be protruded upward than the inner door 41.

The inner door handle 111 may be fully coupled to the coupling member 200 because the inner handle protruding upward from the inner door 41 is slid toward the lower side of the inner door 41.

Therefore, the inner door handle 111 is not only coupled to the inner door 41 from the front to the rear of the inner door 41, but after the inner door handle 111 is coupled to the inner door 41 from the front to the rear of the inner door 41, the inner door handle 111 is also coupled to the inner door 41 from the upper portion to the lower portion of the inner door 41 in a sliding manner. Therefore, it is possible to prevent the inner door handle 111 from moving in the front-rear direction.

That is, it is possible to prevent the inner door handle 111 from being detached from the inner door 41 in the front-rear direction without a separate fixing member configured to prevent, the inner door handle 111 from moving in the front-rear direction.

Meanwhile, in another embodiment of the present disclosure, the inner door handle 111 is not integrally formed, and may be coupled with each other by dividing into a plural of parts. For example, the inner door handle may be coupled with each other by dividing into two. However, it is not limited thereto.

The method that the two inner door handles 111 are coupled to the inner door 41 through the coupling member 200 may most be similar to the method that the inner door handle 111 integrally formed coupled to the inner door 41 through the coupling member 200, however, the two inner door handles 111 may ably coupled up and down, respectively.

In other words, one inner door handle 111 may be slidably downwardly coupled to the inner door 41 after inserted from the front to the rear of the inner door 41, and the other inner door handle 111 may be slidaby upwardly coupled to the inner door 41 after inserted from the front to the rear of the inner door 41.

Each of the inner door handles 111 slidably coupled to the upper side and the lower side of the inner door 41 may be fully coupled to the inner door 41 by being coupled to each other.

Figure 8F:
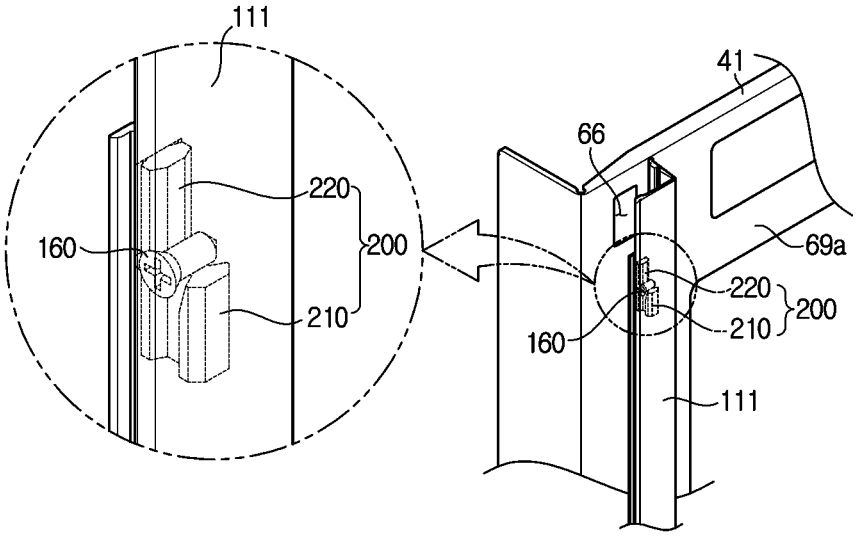

As shown in FIG. 8F, when the inner door handle 111 is coupled to the coupling member 200 in a sliding manner, the fixing member 160 may be fastened to prevent the inner door handle 111 from being detached downward from the coupling member 200.

The fixing member 160 may be disposed to be positioned at upper portion of the first coupling portion 210 and in front of the second coupling portion 220 when the inner door handle 111 is coupled to the coupling member 200.

The fixing member 160 may be in contact with the upper portion of the first coupling portion 210. However, the present disclosure is not limited thereto, and the fixing member 160 may be disposed at various positions as long as that the inner door handle 111 is prevented from being detached from the coupling member 200 downwardly.

The refrigerator 1 according to an embodiment of the present disclosure may reduce the production cost because the number of separate fixing members is reduced by fastening one fixing member 160 to one fixing hole 170 provided in the inner door handle 111.

As shown in FIG. 9, coupling member 200 may include the supporting portion 201 and the frame engaging portion 202. The supporting portion 210 is coupled to the rear surface of the inner door frame 60*a*. The frame engaging portion 202 extends forward from the supporting portion 201 and is disposed at the front surface of the inner door frame 69*a* so that the coupling member 200 is coupled to the inner door frame 69*a*.

The supporting portion 201 may be provided to prevent the coupling member 200 from being detached forward from the coupling hole 70, and the frame engaging portion 202 may be provided to prevent the first coupling portion 210 from being detached rearward from the first coupling hole 71.

The width of the supporting portion 201 may be larger than the width of the coupling portion 70. The width of the frame engaging portion 202 may be larger than the width of the first coupling hole 71 and smaller than the width of the second coupling hole 72.

In order that the inner door handle 111 is coupled to the coupling member 200, the first coupling portion 210 may include the handle assembling portion 213 extending forward from the frame engaging portion 202 and the handle engaging portion 212 extending forward from the handle assembling portion 213.

The cross section of the first coupling portion 210 may include the shape of the approximate capital letter "I" by the frame engaging portion 202, the handle assembling portion 213, and the handle engaging portion 212. However, it is not limited thereto.

The coupling member 200 may include a frame assembling portion 211 provided between the supporting portion 201 and the frame engaging portion 202. The width of the frame assembling portion 211 may be smaller than the width of the first coupling hole 71.

When the coupling member 200 is coupled to the inner door frame 69*a*, the frame assembling portion 211 and the inner door frame 69*a* may be coupled. Meanwhile, the coupling member 200 may be coupled to the inner door frame 69*a* without being detached from the inner door frame 69*a* by the interference between the inner door frame 69*a* and the frame engaging portion 202.

The inner door handle 111 may include a receiving portion 130 coupled with the coupling member 200 and the first grip portion 141 bent and extended from the receiving portion 130 and provided to grip the inner door 41.

The receiving portion 130 may include a first receiving portion 131 in which the frame engaging portion 292 is received and a second receiving portion 132 in which the handle engaging portion 212 is received.

The receiving portion 130 may include the protruding portion 133 protruding inward of the receiving portion 130 between the first receiving portion 131 and the second receiving portion 132 to prevent the inner door handle 111 from being detached from the coupling member 200 forward.

Therefore, the inner door handle 111 may be coupled without being detached from the coupling member 200 because the protruding portion 133 interferes with the handle engaging portion 212.

The shapes of the frame engaging portion 202, the handle engaging portion 212, the first receiving portion 131, the second receiving portion 132, and the protruding portion 133 are not limited and may be variously provided as long as that the inner door frame 69*a*, the coupling member 200 and the inner door handle 111 are maintained in engagement.

Figure 10:
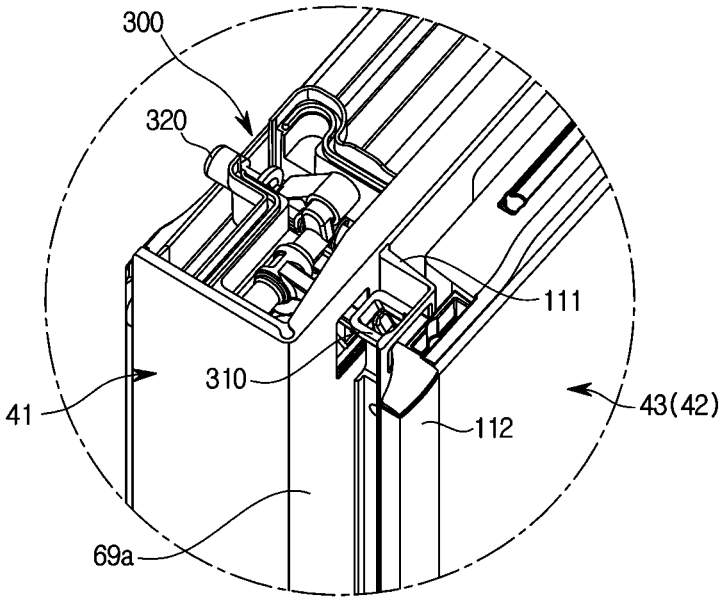
FIG. 10 is a view illustrating the structure of a locking unit in the refrigerator according to an embodiment of the present disclosure.
Figure 11:
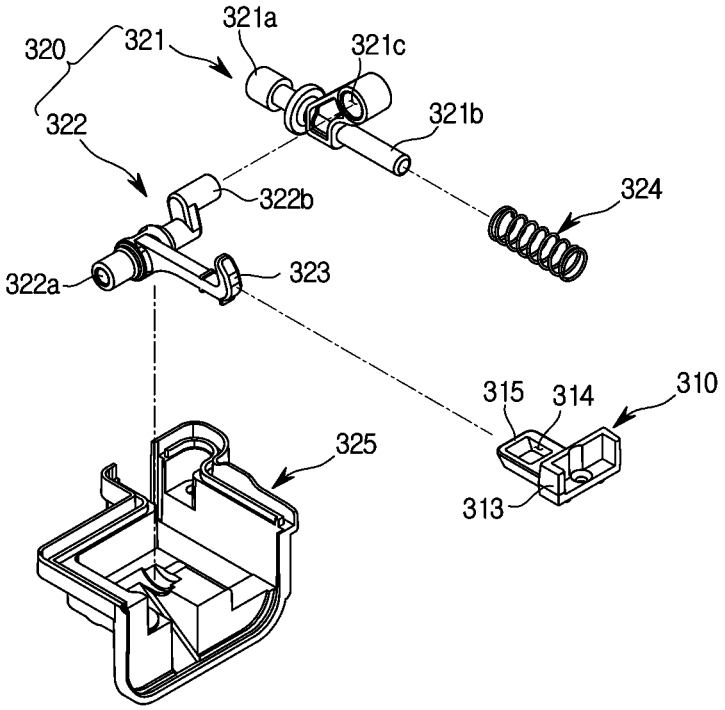
FIG. 11 is an exploded view illustrating the structure of the locking unit in the refrigerator shown in the FIG. 10.

FIG. 10 is a view illustrating the stricture of a locking unit in the refrigerator according to an embodiment of the present disclosure. FIG. 11 is an exploded view illustrating the structure of the locking unit in the refrigerator shown in the FIG. 10.

As shown in FIGS. 6, 7, 10, and 11, the refrigerator 1 according to an embodiment of the present disclosure may include the locking unit 300 provided to couple or detach the inner door 41 and the outer door 42.

The locking unit 300 may include an upper locking unit disposed at the upper portion of the first door 40 to couple or detach the inner door 41 and the first outer door 43, and a lower locking unit disposed at the lower portion of the first door 40 to couple or detach the inner door 41 and the second outer door 44 and.

Since the internal structures of the upper locking unit and the lower locking unit are mostly similar except for a position thereof, the locking unit 300 provided at the upper portion of the first door 40 is mainly described.

The inner door frame 69*a* may include a latch hole 66 through which the locking unit 300 passes. The inner door handle 111 may include a first striker hole 311 through which the locking unit 300 passes.

The latch cover 330 to cover the latch hole 66 may include a second striker hole 312 through which the locking unit 300 penetrating the latch hole 66 passes and a cover cap 331 to cover the second striker hole 312 and the first striker hole 311.

The cover cap 331 may prevent the beauty from being hindered by the first striker hole 311 and the second striker hole 312 when the outer door 42 is opened only, and at the same time, the cover cap 331 may include a substantially cross-shaped insertion hole so that a striker 310 provided at the outer door 42 is inserted. However, it is not limited thereto.

The cover cap 331 may include a rubber material.

By being covered by the inner door handle 111, the latch cover 330 to cover the latch hole 66 may not be exposed to the outside when viewed from the front.

The locking unit 300 may prevent the outer door 42 from being opened unintentionally due to inertia when the inner door 41 is opened.

When the user opens the inner door 41 by grasping the inner door handle 111, pivotal movement of the inner door 41 is stopped after the inner door 41 is sufficiently opened, and at this time, the outer door 42 may be unintentionally opened, when the inertial force of rotation generated during the pivotal movement of the inner door 41 is greater than the engagement force between the inner door 41 and the outer door 42.

This is because the pivotal movement directions of the inner door 41 and the outer door 42 are identical, and the outer door 42 is connected to the inner door 41 by the hinge 67.

The locking unit 300 may allow the outer door 42 to be opened although the inner door 41 is closed and prevent the outer door 42 from being opened when the inner door 42 is opened.

The locking unit 300 may include the striker 310 coupled to the upper portion of the outer door 42, and a latch 320 coupled to the upper portion of the inner door 41 and engaged with or disengaged from the striker 310 in accordance with opening or closing of the inner door 41.

The latch 320 may include an actuating bar 321 to be pressed by the main body 10 such that the actuating bar 321 is rectilinearly movable, and a rotating bar 322 to perform rotation in accordance with rectilinear movement of the actuating bar 321. The rotating bar 322 is provided with an engaging hook 323 formed at one end thereof.

The latch 320 may include a returning spring 324 to return the actuating bar 321 to an original position thereof when a pressing force from the main body 10 to the actuating bar 321 is released.

The actuating bar 321 may include a head portion 321*a* to which the pressing force from the main body 10 is directly applied, and a body portion 321*b* connected to the head portion 321*a*.

The rotating bar 322 may include a rotating shaft 322*a* as a rotation center, and a connecting shaft 322*b* connected to the actuating bar 321 to receive drive force from the actuating bar 321. The connecting shaft 322*b* may be arranged to be eccentric from the rotating shaft 322*a*.

A connecting hole 321*c* may be formed at the actuating bar 321 and, as such, the connecting shaft 322*b* of the rotating bar 322 may be rotatably inserted into the connecting hole 321*c*.

The locking unit 300 may include a housing 325 to receive the actuating bar 321, rotating bar 322, and the returning spring 324. The housing 325 may be coupled to the upper portion of the inner door 41.

The striker 310 may include a coupling plate 313 to be coupled to the upper portion of the outer door 42, and an arm bar 315 formed with a coupling hole 314 into which the engaging hook 323 of the latch 320 may be inserted.

The coupling plate 313 may be coupled to the upper portion of the first outer door 43 by a fastening member (not shown). The striker 310 may be formed to have an integrated structure, using stainless steel.

Figure 12:
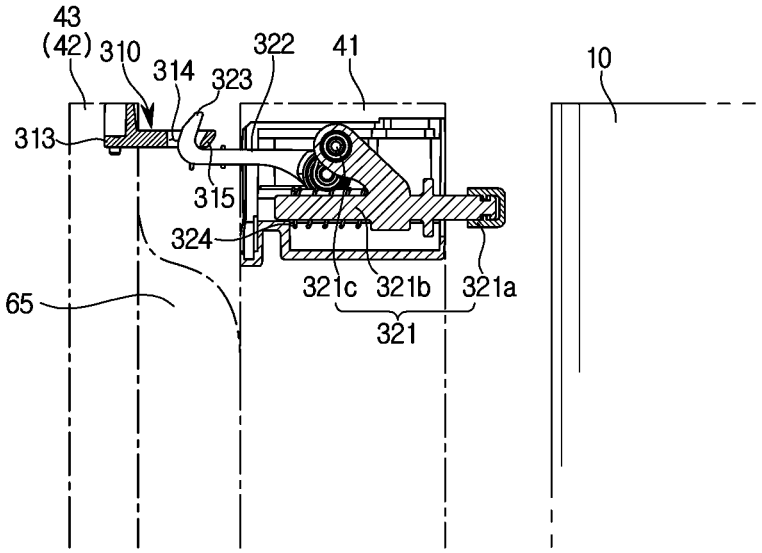
FIG. 12 is a view illustrating an operation of the locking unit when the inner door and the outer door are opened together in the refrigerator according to an embodiment of the present disclosure.
Figure 13:
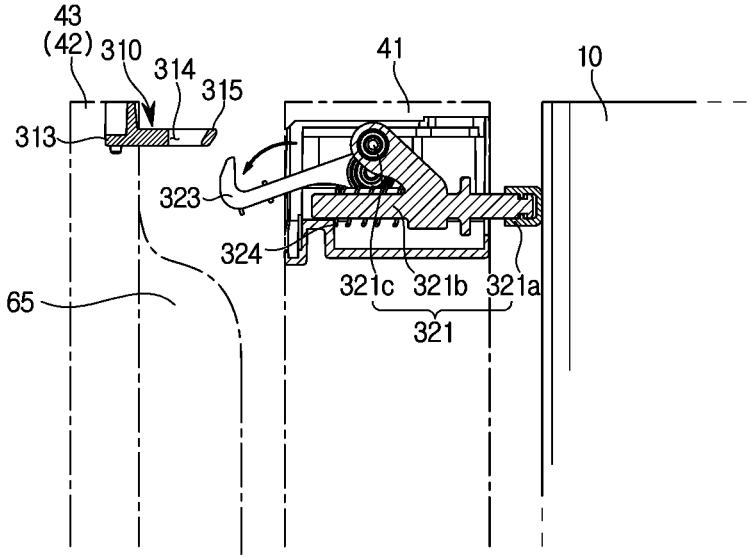
FIG. 13 is a view illustrating the operation of the locking unit when only the outer door is opened in the refrigerator according to an embodiment of the present disclosure.

FIG. 12 is a view illustrating an operation of the locking unit when the inner door and the outer door are opened together in the refrigerator according to an embodiment of the present disclosure. FIG. 13 is a view illustrating the operation of the locking unit when only the outer door is opened in the refrigerator according to an embodiment of the present disclosure.

As shown in FIGS. 12 and 13, when the inner door 41 and the outer door 42 are opened together, the actuating bar 321 may be moved in the direction toward the main body 10 by the returning spring 324 to restore the actuating bar 321 to its original position because the pressure applied to the head portion 321*a* by the main body 10 disappears.

The engaging hook 323 may be engaged with the engaging groove 314 as the rotating bar 322 is rotated upward in conjunction the movement of the actuating bar 321. The outer door 42 and the 41 may be opened together as the rotating bar 322 and the striker 310 are coupled because the engaging hook 323 is engaged with the engaging groove 314.

Conversely, when only the outer door 42 is opened, the actuating bar 321 may maintain the position shifted away from the main body 10 because the pressure of the head 321*a* by the main body 10 is continuously maintained.

The engaging hook 323 may be released from the engaging groove 314 because the rotating bar 322 may be maintained in a state of being rotated downward by the maintenance position of the actuating bar 321. The rotating bar 322 and the striker 310 may be released since the engaging hook 323 is released from the engaging groove 314.

Accordingly, the outer door 42 may be opened regardless of the inner door 41.

Figure 14:
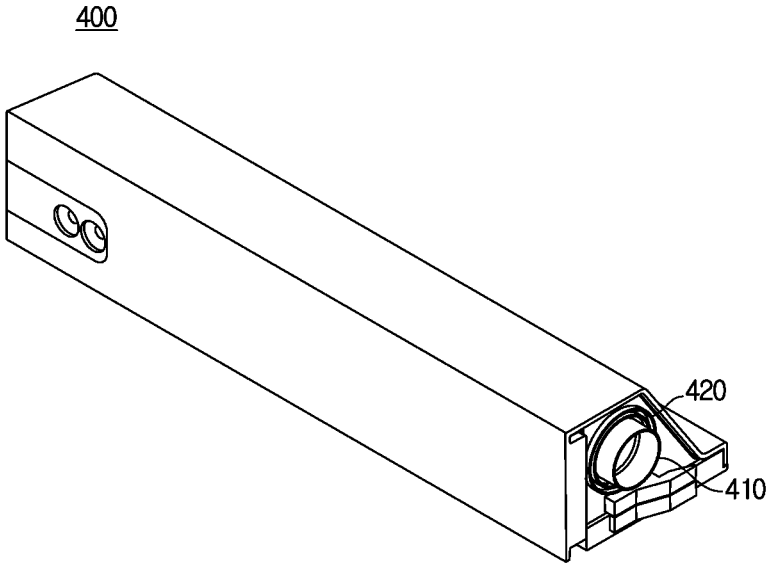
FIG. 14 is a view illustrating a filling inlet and a rib of an insulating partition wall in the refrigerator according to an embodiment the present disclosure.
Figure 15:
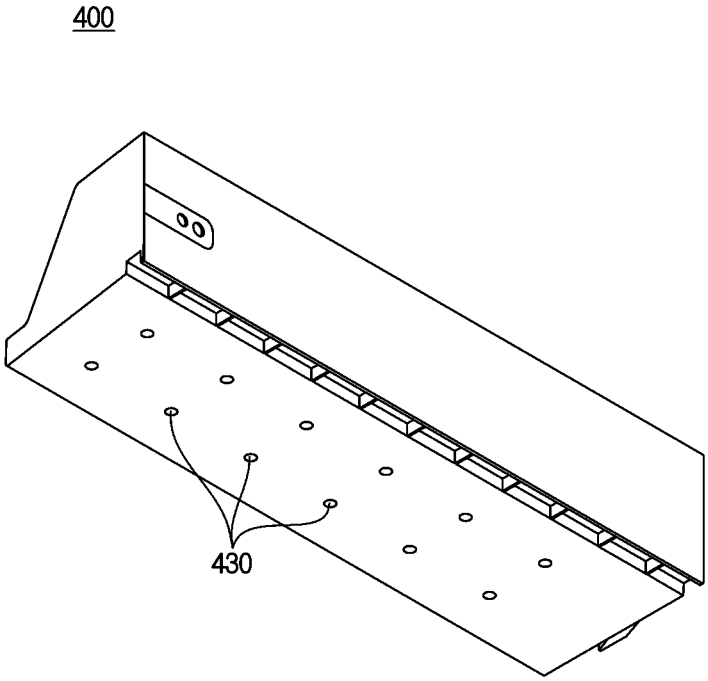
FIG. 15 is a view illustrating an outlet of the insulating partition wall in the refrigerator shown in the FIG. 14.

FIG. 14 is a view illustrating a filling inlet and a rib of an insulating partition wall in the refrigerator according to an embodiment of the present disclosure. FIG. 15 is a view illustrating an outlet of the insulating partition wall in the refrigerator shown in the FIG. 14.

As shown in FIGS. 14 and 15, the refrigerator 1 according to an embodiment of the present disclosure may include the insulating partition wall 400 positioned between the upper door 51 and the lower door 52 to insulate the inside and the outside of the freezing compartment 20*b*.

As shown in FIG. 2, FIGS. 14 and 15 are an exploded view illustrating the structure of the insulating partition 400 disposed between the upper door 51 and the lower door 52.

The insulating partition wall 400 may be coupled to the inner case 12 to be filled together with the insulating material (not shown) filled between the inner case 12 and the outer case 11.

The temperature difference between the inside and the outside of the freezing chamber 20*b* may be large since the temperature of the freezing chamber 20*b* is relatively lower than the temperature of the refrigerating chamber 20*a*. That is, the seal of the insulating partition wall 400 may be required to be larger than that of the refrigerating chamber 20*a*.

Accordingly, the insulating partition wall 400 may provide a surface to which the gasket 63 may be adhered by being disposed between the upper door 51 and the lower door 52 like a normal middle partition wall, and furthermore, the insulating partition wall 400 may have better the seal and the insulating property than a normal middle partition wall.

In order to ensure the seal and the insulation, the insulating partition wall 400 may include a filling inlet 410 connected to the inner case 12 so that the insulating partition wall 400 is filled with the insulating material (not shown) from the inner case 12, and a rib 420 provided adjacent to the filling inlet 410 to prevent leakage of the insulating material (not shown) filled in the insulating partition wall 400 through the filling inlet 410.

Although the filling inlet 410 shown in FIG. 14 is illustrated as being substantially circular, the present disclosure is not limited thereto, and the filling inlet 410 may have various shapes.

The rib 420 may be configured in a substantially circular shape to correspond to the shape of the filling inlet 410 and provided to be adjacent to the filling inlet 410. The ribs 420 may be provided of two ribs corresponding to a single inner rib and a single outer rib.

However, the number and position of the ribs 420 are not limited to the above, and may be variously arranged to prevent the leakage of the insulating material (not shown) filled from the inner case 12 into the filling inlet 410.

The insulating partition wall 400 may include an outlet 430 provided to discharge the gas of the insulating material (not shown) filled into the insulating partition wall 400 to the outside of the insulating partition wall 400.

A plurality of outlets 430 may be provided at the lower portion of the insulating partition wall 400. However, the present disclosure is not invited thereto, and the outlet 430 may be variously arranged to discharge the gas, which is generated when the insulating material (not shown) is charged from the inner case 12 to the insulating partition wall 400, to the outside of the insulating partition wall 400.

The insulating partition wall 400 may be sealed to prevent the leakage of the insulating material (not shown). The insulating partition wall 400 may be formed separately from the inner case 12 and the outer case 11 and then coupled to the inner case 12 so as to insulate the freezing compartment 20*b* from the outside.

A filling connecting hole (not shown) is provided in the inner case 12 so that the insulating material (not shown) is filled into the insulating partition wall 400 through the filling hole 410 provided at one side of the insulating partition wall 400.

The insulating material (not shown) filled inside the insulating partition wall 400 through a filling connecting hole (not shown) may be the same as the insulating material (not shown) filled between the inner case 12 and the outer case 11.

Although the technical idea of the present disclosure according to specific embodiments have been described above, the scope of the present disclosure is not limited to the above embodiments.

Various embodiments that may be made by one of ordinary skill in the art to which the present disclosure pertains by modifying or changing the above embodiments within the scope not departing from the gist of the technical idea of the present disclosure defined by the appended claims also belong to the scope of the present disclosure.

INDUSTRIAL APPLICABILITY

Sequence List Text

The invention claimed is:

1. A refrigerator comprising:

a main body having a storage compartment;

an inner door rotatably couplable to the main body to open and close the storage compartment, and having an inner door frame including a first coupling hole and a second coupling hole passing through a front surface of the inner door frame, and the second coupling hole formed to extend from the first coupling hole and larger than the first coupling hole;

an outer door rotatably couplable to the inner door;

an inner door handle couplable to the inner door frame to open the inner door together with the outer door;

an outer door handle, provided at the outer door to open the outer door, and configured to cover the inner door handle; and a coupling member including a first coupling portion couplable to the first coupling hole and a second coupling portion formed to be extended upward from the first coupling portion and having a smaller length protruding forward than the first coupling portion, the coupling member further including a supporting portion couplable to a rear surface of the inner door frame, and a frame engaging portion extended forward from the supporting portion and disposed at the front surface of the inner door frame so that the coupling member is couplable to the inner door frame in a sliding manner, wherein the first coupling portion comprises a handle engaging portion extended forward from the frame engaging portion so that the inner door handle is coupled to the coupling member in a sliding manner, wherein the inner door handle includes a receiving portion couplable with the coupling member, the receiving portion comprising a first receiving portion in which the frame engaging portion is receivable and a second receiving portion in which the handle engaging portion is receivable, and a protruding portion protruding inward of the receiving portion between the first receiving portion and the second receiving portion to prevent the inner door handle from being detached from the coupling member along a forward direction, and wherein a width of the frame engaging portion is larger than a width of the first coupling hole, and smaller than a width of the second coupling hole.

2. The refrigerator of claim 1, wherein the supporting portion is provided to prevent the coupling member from being detached from the inner door frame, and the frame engaging portion is provided to prevent the first coupling portion from being detached from the first coupling hole.

3. The refrigerator of claim 1, wherein the inner door handle comprises a grip portion bent and formed to extend from the receiving portion.

4. The refrigerator of claim 1, wherein the inner door handle comprises a fixing member provided to prevent the inner door handle from being detached from the coupling member and a fixing hole coupled with the fixing member.

5. The refrigerator of claim 4, wherein the fixing member is disposed on the first coupling portion and in front of the second coupling portion, when the inner door handle is coupled to the coupling member.

* * * * *